US005176569A

United States Patent [19]

Jardinier et al.

[11] Patent Number: 5,176,569

[45] Date of Patent: Jan. 5, 1993

[54] BLOWER TERMINAL FOR A BUILDING VENTILATION SYSTEM

[75] Inventors: Pierre Jardinier, Gournay sur Marne; Jacques Simonnot, Lesigny, both of France

[73] Assignee: Societe d'Etude et de Recherche en Ventilation et Aeraulique S.E.R.V.A., Bussy Saint Georges, France

[21] Appl. No.: 690,685

[22] Filed: Apr. 24, 1991

[30] Foreign Application Priority Data

Apr. 26, 1990 [FR] France ..... 90 05837

[51] Int. Cl.[5] ..... F24F 13/10

[52] U.S. Cl. ..... 454/305; 454/307

[58] Field of Search ..... 454/284, 303, 304, 305, 454/307, 308, 326, 327

[56] References Cited

U.S. PATENT DOCUMENTS

| | | | |
|---|---|---|---|
| 2,281,615 | 5/1942 | Peple, Jr. | 454/326 X |
| 2,312,272 | 2/1943 | Stacey, Jr. | 454/305 |
| 3,541,944 | 11/1970 | Kristiansen | 454/305 |
| 3,759,157 | 9/1973 | Läkfeldt et al. | 454/305 |
| 5,044,259 | 9/1991 | Cazan et al. | 454/305 |

FOREIGN PATENT DOCUMENTS

| | | | |
|---|---|---|---|
| 971025 | 11/1958 | Fed. Rep. of Germany | 454/313 |
| 1088688 | 9/1960 | Fed. Rep. of Germany | 454/333 |
| 2739370 | 3/1979 | Fed. Rep. of Germany | 454/303 |
| 3634703 | 4/1988 | Fed. Rep. of Germany . | |
| 830081 | 5/1981 | U.S.S.R. | 454/284 |
| 898223 | 1/1982 | U.S.S.R. | 454/284 |
| 1325260 | 7/1987 | U.S.S.R. | 454/299 |
| 2002896 | 2/1979 | United Kingdom . | |

*Primary Examiner*—Harold Joyce
*Attorney, Agent, or Firm*—Oliff & Berridge

[57] ABSTRACT

A terminal for a building ventilation system has, in combination, a throttle nozzle located at the downstream end of an air inlet duct and a curved surface located in the room near the outlet of the duct such as to present its curved surface to the air stream and to be located outside the extension of the opening of the regulating nozzle.

19 Claims, 2 Drawing Sheets

BLOWER TERMINAL FOR A BUILDING VENTILATION SYSTEM

TECHNICAL FIELD

The present invention relates to a blower terminal designed to regulate the flow rate and diffusion of an air flow for a building ventilation system.

BACKGROUND

Ventilating buildings, particularly office buildings, by blowing air into them is known. Air entering through an intake on the building's roof, for example, so that it is as clean as possible, is blown in by a fan under high pressure inside the main duct to which are connected branch ducts going to the various rooms, the branch ducts being equipped with balancing registers that may or may not be regulatable. However, balancing is never perfect. Moreover, these systems have a regulating system in each ventilated room. Thus there must be a register in each room to perform this regulation. This register produces noise problems, however, because the register is close to the room or zone into which the air is diffused. Hence it is necessary to provide a sound trap such as a grid with a large cross section to cover the whole. This structure takes up a great deal of space and some of the component parts such as the register are hidden, which makes for difficult maintenance.

SUMMARY OF THE INVENTION

A goal of the present invention is to provide a blower terminal having elements for regulating and diffusing the blown air that are accessible from inside the room it serves and which does not require specific sound traps.

This and other objects are achieved by a blower terminal which has, in combination, a throttle nozzle located at the downstream end of the air intake duct and a curved deflecting surface located in the air outlet zone in the room to be ventilated such that the air stream encounters the outside of its curve.

Surprisingly, this arrangement deflects the air flow relative to the duct outlet axis, with this deflection occurring not on the side opposite the side where the deflecting surface is located, but on the side of the deflecting surface. This produces a type of rolling air stream along this surface and creates a vortex movement around the surface.

According to one embodiment of the invention, the deflecting surface is located at a tangent to the air stream leaving the nozzle.

According to another embodiment, the deflecting surface completely or partially blocks the air stream leaving the nozzle, with the angles formed by the air streams with the deflecting surface at the points where they impinge on it being less than 90°.

According to one arrangement, the deflecting surface is in an air outlet zone separated from the wall of the ventilated room, and thus also from the throttle nozzle, with the throttle nozzle having two symmetrical flaps articulated to rotate around axes parallel to the axis of the deflecting surface.

According to another characteristic of the invention, the deflecting surface is adjustably mounted, preferably on two supports mounted on the wall to which the air inlet duct leads. It is thus possible precisely to regulate the position of the deflecting surface such that it ensures deflection of the air stream in the desired direction under optimum conditions.

According to one embodiment of the invention, part of the surface of a cylinder constitutes the deflecting surface.

BRIEF DESCRIPTION OF THE DRAWINGS

The invention will be thoroughly understood with the aid of the description herein and with reference to the attached schematic drawings representing one embodiment of the invention as a nonlimiting example.

DETAILED DESCRIPTION OF PREFERRED EMBODIMENTS

Figure 1:
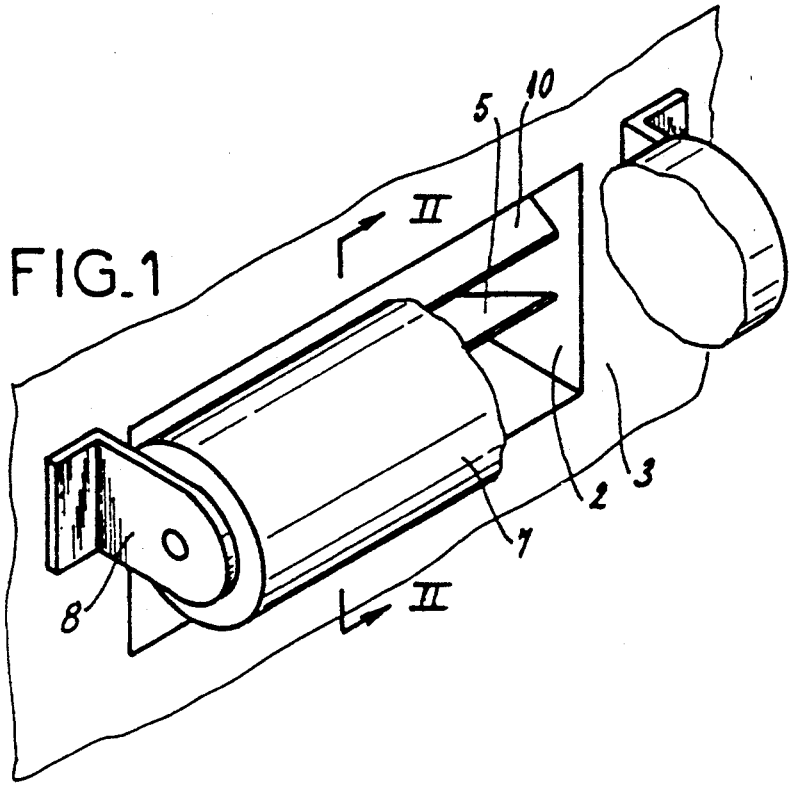
FIG. 1 is a perspective view in which the deflecting surface is partially cut away.
Figure 2:
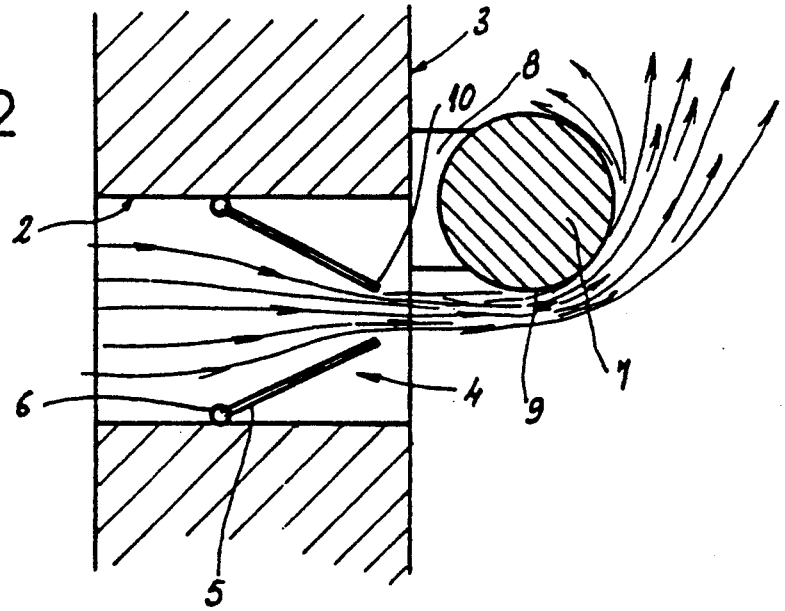
FIG. 2 is a cross section along line II—II in FIG. 1.

FIGS. 1 and 2 represent an air inlet duct 2 terminating in a room, one of whose walls is designated by reference numeral 3. Near its downstream end, air inlet duct 2 is equipped with a throttle nozzle 4 having two flaps 5, each preferably rectangular in shape and articulated to rotate around a horizontal axis 6, the two axes 6 being disposed at the upstream ends of the two flaps 5.

According to the invention, wall 3, downstream of the outlet of duct 2, is equipped with an air deflection surface 7 which in the depicted case is a cylinder 7. This cylinder is mounted on the wall with two brackets 8. The position of the cylinder relative to duct 2 is at least vertically adjustable with the aid of means not shown in the drawing. These means could comprise, for example, a tongue and groove arrangement by which brackets 8 are slidable on wall 3 or by which cylinder 7 is slidable on brackets 8.

In FIG. 2, the lowest generatrix 9 of cylinder 7 is substantially tangential to the upper part of the air stream leaving the throttle nozzle. When the air stream leaves duct 2, the attraction exerted by cylinder 7 causes it to deflect at this cylinder. This deflection is effected substantially totally soundlessly, despite the acceleration of the air stream as it passes through the throttle nozzle.

Figure 3:
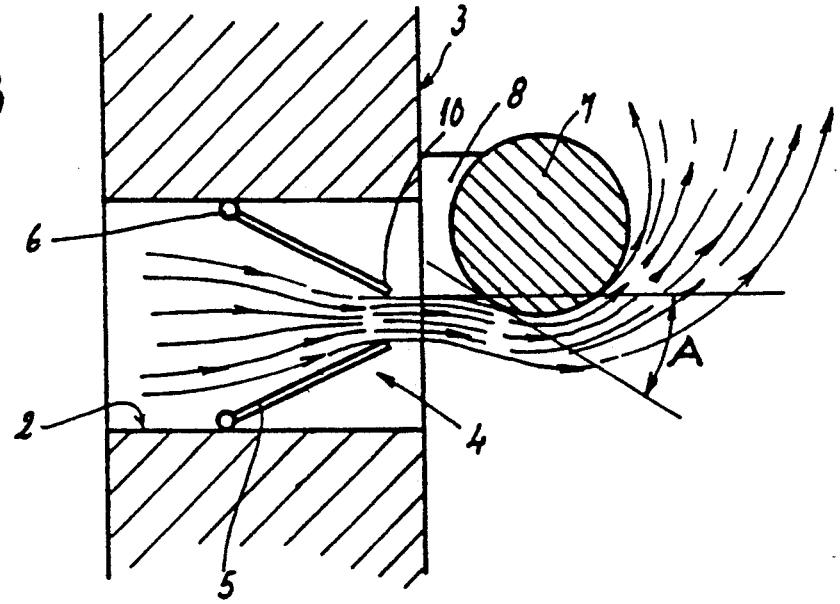
FIGS. 3 and 4 are two views similar to FIG. 2 and representing two other possible positions of the deflecting surface relative to the air stream.
Figure 4:
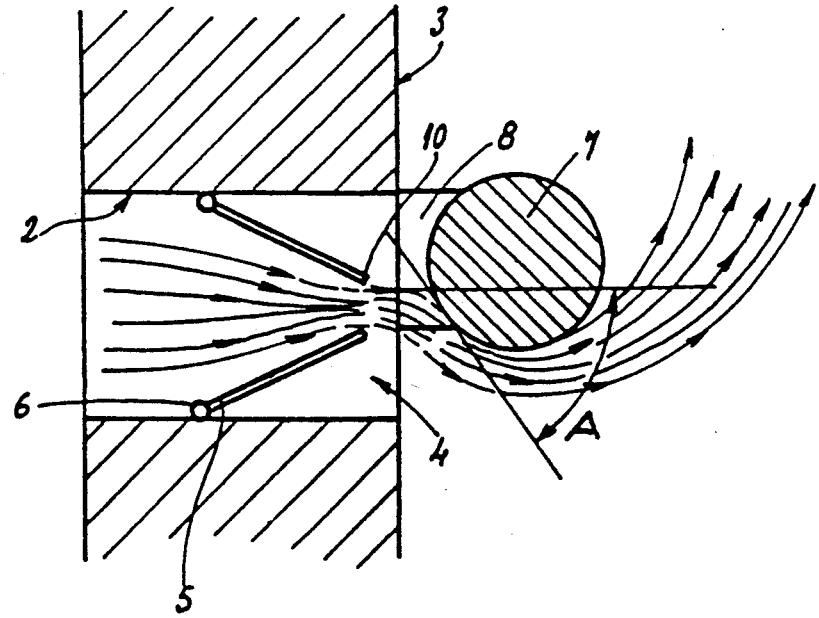

FIGS. 3 and 4 represent this terminal in which deflecting surface 7 occupies two other positions.

In FIG. 3, cylinder 7 partially blocks the outlet of nozzle 4, while in FIG. 4 it blocks it totally. In both cases, the angles A between the various air streams leaving throttle nozzle 4 and the tangents of cylinder 7, at their respective points of impact thereon, are less than 90°. This characteristic ensures deflection of the air stream at the deflecting surface.

It emerges from the foregoing that the invention affords a great improvement to existing technology by providing a terminal of very simple design wherein all the elements are easily accessible, which is advantageous from the standpoint of maintenance, and has a pleasing aesthetic appearance, different from the appearance of traditional devices whose outlets are always blocked by a grid.

It goes without saying that the invention is not confined to the embodiment of this terminal described above as an example; on the contrary, it covers all alternative embodiments. Thus, in particular, the air stream deflecting surface may be not a cylinder but a frustroconical part with a cylindrical or noncylindrical surface, for example, a section of an ellipse, without thereby departing from the scope of the invention.

We claim:

1. A blower terminal for a building ventilation system, comprising an air inlet duct having a downstream end, a throttle nozzle located at said downstream end of said air inlet duct for defining an air stream of air exiting said air inlet duct into an air outlet zone, and a convexly curved deflecting surface located in said air outlet zone for deflecting said air stream, wherein said deflecting surface completely or partially blocks said air stream, with angles between the air stream and the curved deflecting surface at points of impact of said air stream on said curved deflecting surface being less than 90°.

2. A blower terminal according to claim 1, wherein said nozzle is located in a wall of a room of the building and said air outlet zone is located inside said room.

3. A blower terminal according to claim 2, wherein said curved deflecting surface is separate from said wall.

4. A blower terminal according to claim 1, wherein said throttle nozzle has two symmetrical flaps articulated to rotate around axes at upstream ends of said flaps.

5. A blower terminal according to claim 1, wherein said curved deflecting surface is adjustably mounted.

6. A blower terminal according to claim 5, wherein a location of said curved deflecting surface is vertically, adjustable.

7. A blower terminal according to claim 5, wherein said curved deflecting surface is adjustably mounted on two brackets located at opposite sides of said throttle nozzle.

8. A blower terminal according to claim 2, wherein said curved deflecting surface is a cylinder.

9. A blower terminal according to claim 3, wherein said curved deflecting surface is a cylinder.

10. A blower terminal according to claim 4, wherein said curved deflecting surface is a cylinder.

11. A blower terminal according to claim 5, wherein said curved deflecting surface is a cylinder.

12. A blower terminal according to claim 6, wherein said curved deflecting surface is a cylinder.

13. A blower terminal according to claim 7, wherein said curved deflecting surface is a cylinder.

14. A blower terminal for a building ventilation system, according to claim 1, wherein said air outlet zone is separate from said throttle nozzle.

15. A blower terminal for a building ventilation system, comprising an air inlet duct having a downstream end, a throttle nozzle located at said downstream end of said air inlet duct for defining an air stream of air exiting said air inlet duct into an air outlet zone, and a convexly curved deflecting surface, defining a cylinder, located in said air outlet zone for deflecting said air stream.

16. A blower terminal according to claim 15, wherein said curved deflecting surface is located at a tangent to the air stream.

17. A blower terminal according to claim 15, wherein said curbed deflecting surface completely or partially blocks the air stream, with angles between the air stream and the curved deflecting surface at points of impact of said air stream on said curved deflecting surface being less than 90°.

18. A blower terminal according to claim 15, wherein said cylinder has a substantially horizontal axis.

19. A blower terminal for a building ventilation system, according to claim 15, wherein said air outlet zone is separate from said throttle nozzle.

* * * * *